US007432872B1

(12) United States Patent
Waller

(10) Patent No.: US 7,432,872 B1
(45) Date of Patent: Oct. 7, 2008

(54) COMPACT AVIATION VERTICALLY POLARIZED LOG PERIODIC ANTENNA

(75) Inventor: Marsellas L. Waller, Huntsville, AL (US)

(73) Assignee: The United States of America as represented by the Secretary, Washington, DC (US)

( * ) Notice: Subject to any disclaimer, the term of this patent is extended or adjusted under 35 U.S.C. 154(b) by 46 days.

(21) Appl. No.: 11/796,461

(22) Filed: Apr. 27, 2007

(51) Int. Cl.
*H01Q 11/10* (2006.01)

(52) U.S. Cl. ..... 343/792.5; 343/705; 343/728; 343/786; 343/795; 343/805; 343/867; 343/891

(58) Field of Classification Search ..... 343/792.5, 343/705, 795, 786, 867, 891
See application file for complete search history.

(56) References Cited

U.S. PATENT DOCUMENTS 3,683,390 A * 8/1972 Cory et al. ..... 343/792.5
3,732,572 A * 5/1973 Kuo ..... 343/792.5
4,616,233 A * 10/1986 Westerman ..... 343/792.5
5,966,100 A * 10/1999 Podger ..... 343/742
5,995,060 A * 11/1999 Podger ..... 343/807
6,020,857 A * 2/2000 Podger ..... 343/742
6,057,805 A * 5/2000 Harrington ..... 343/792.5
6,121,937 A * 9/2000 Podger ..... 343/792.5

* cited by examiner

*Primary Examiner*—Douglas W. Owens
*Assistant Examiner*—Chuc Tran
(74) *Attorney, Agent, or Firm*—Alan P. Klein

(57) ABSTRACT

A reduced height log periodic antenna that may safely be positioned under the rotating blades of a helicopter sitting on the ground and still resonate in the frequency range at which the antenna was originally designed to resonate. The antenna comprises a pair of antenna booms, a first plurality of vertical antenna radiating elements connected to the booms, and a second plurality of vertical antenna radiating elements connected to the booms. In addition, the antenna includes a plurality of tuned horizontal antenna radiating elements, each tuned horizontal radiating element being connected to the top of one of the second plurality of vertical antenna radiating elements, and a plurality of tuned upwardly bent horizontal antenna radiating elements, each tuned upwardly bent horizontal antenna radiating element being connected to the bottom of one of the second plurality of vertical antenna radiating elements. The antenna is characterized by the fact that the second plurality of antenna radiating elements have been shortened from their original design length to fit vertically under the rotating blades of a helicopter, and the tuned horizontal radiating elements have been added to the shortened radiating elements to bring the shortened radiating elements back to their desired frequency response.

15 Claims, 5 Drawing Sheets

COMPACT AVIATION VERTICALLY POLARIZED LOG PERIODIC ANTENNA

BACKGROUND OF THE INVENTION

This invention relates in general to antennas, and more particularly, to log periodic antennas.

MIL-STD-464A, entitled "Electromagnetic Environmental Effects Requirements for Systems," 19 Dec. 2002, and ADS-37A-PRF, entitled "Electromagnetic Environmental Effects (E3) Performance and Verification Requirements," 28 May 1996, set out stringent electric field requirements for the electromagnetic vulnerability testing of Army helicopters. The antenna generating the test field must generate a test field at levels between 200-264V/m in the 44-150 MHz frequency range, while remaining safe under the helicopter with the rotors turning. Below that frequency range, a whip antenna is used and above that range, standard horn antennas are used. To obtain the required fields, the typical setup includes high power RF amplifiers (10 kW) with heavy duty coaxial cables leading to a log periodic antenna. Typical engineering design for an antenna to efficiently and effectively operate in this frequency range would require a 6 feet long log periodic antenna with the longest elements being about 12 feet in length. When this antenna is turned vertically to create a vertically polarized field, and given a few inches of ground separation, the antenna height would approach 12+ feet. However, standard operating procedures mandate that anything under the rotating helicopter blades must be no more than 6 feet tall. Taking an antenna that is 12 feet tall and reducing the height in half, while still getting the antenna to resonate in the desired test frequency range presents a significant engineering challenge.

SUMMARY OF THE INVENTION

It is therefore an object of this invention to reduce the height of a log periodic antenna so that the antenna may safely be positioned under the rotating blades of a helicopter sitting on the ground and still resonate in the frequency range at which the antenna was originally designed to resonate.

This and other objects of the invention are achieved in one aspect by a reduced height vertically polarized log periodic antenna. The antenna comprises a pair of antenna booms, a first plurality of vertical antenna radiating elements connected to the booms, and a second plurality of vertical antenna radiating elements connected to the booms. In addition, the antenna includes a plurality of tuned horizontal antenna radiating elements, each tuned horizontal radiating element being connected to the top of one of the second plurality of vertical antenna radiating elements, and a plurality of tuned upwardly bent horizontal antenna radiating elements, each tuned upwardly bent horizontal antenna radiating element being connected to the bottom of one of the second plurality of vertical antenna radiating elements. The antenna is characterized by the fact that the second plurality of antenna radiating elements have been shortened from their original design length to fit vertically under the rotating blades of a helicopter, and the tuned horizontal radiating elements have been added to the shortened radiating elements to bring the shortened radiating elements back to their desired frequency response.

Another aspect of the invention involves a method of reducing the height of a vertically polarized log periodic antenna comprising the steps of providing the vertically polarized log periodic antenna, shortening any radiating elements of the antenna that are too long to fit vertically under the rotating blades of a helicopter, adding tuned upper and lower horizontal radiating elements to the shortened radiating elements to bring the shortened radiating elements back to their desired frequency response, and bending the tuned lower horizontal radiating elements upwards away from the ground to reduce the capacitive coupling to the ground.

Additional advantages and features will become apparent as the subject invention becomes better understood by reference to the following detailed description when considered in conjunction with the accompanying drawings wherein:

DETAILED DESCRIPTION

Figure 1:
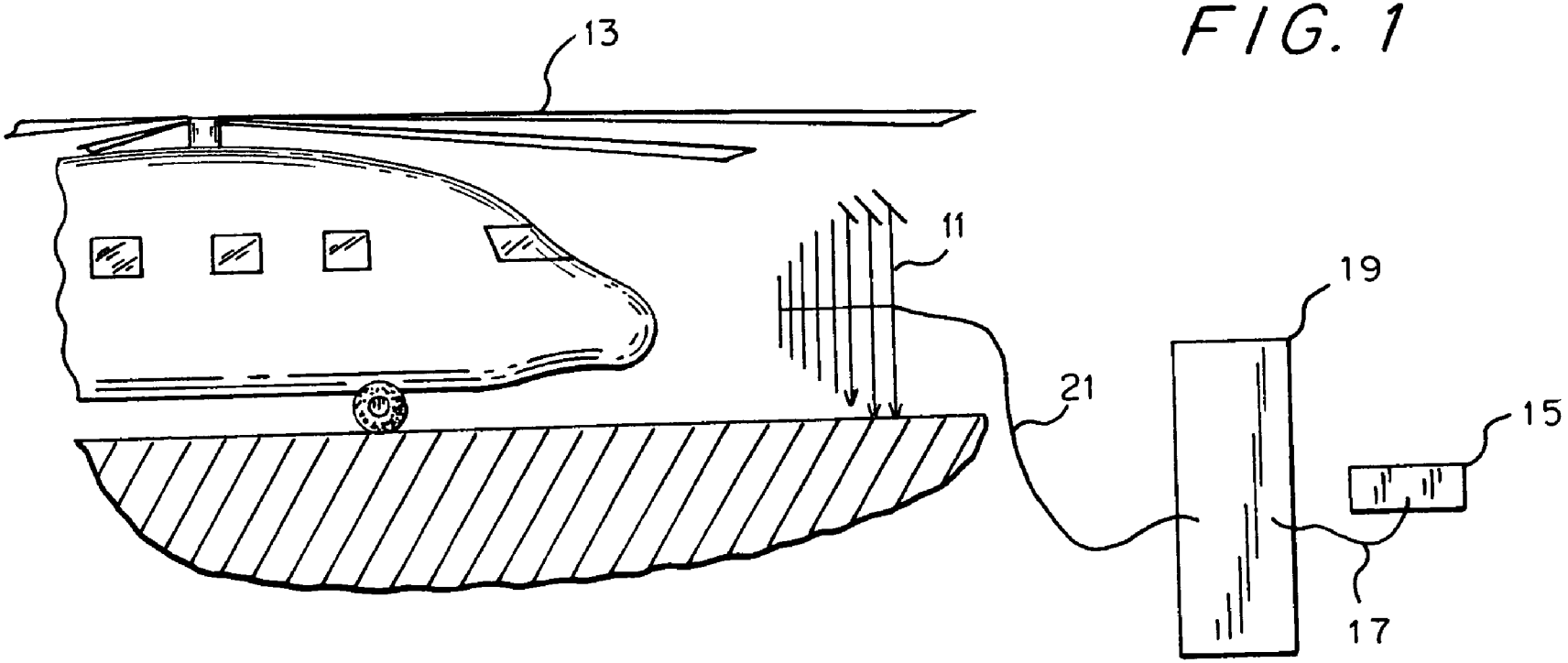
FIG. 1 shows an electromagnetic vulnerability test setup in which a vertically polarized log periodic antenna is disposed under the main rotors of a helicopter in accordance with the invention.

FIG. 1 shows an electromagnetic vulnerability test setup in which a vertically polarized log periodic antenna 11 is disposed under the main rotors of a helicopter 13 in accordance with the invention. Several elements make up a helicopter electromagnetic vulnerability test setup. A signal generator 15 generates a radio frequency (RF) signal. The RF signal has the following characteristics: (a) frequency, (b) modulation, and (c) amplitude. The frequency is in megahertz (MHz). Typically, only one discrete frequency is tested at a time, not the entire frequency range. The modulation may be continuous wave (CW), amplitude modulated (AM), frequency modulated (FM) or pulse modulated (PM). The amplitude is in milliwatts expressed in decibels (dBm). A coaxial cable 17 carries the low power signal to a high power RF amplifier 19. The high power RF amplifier 19 amplifies the low power signal up to kilowatts. A coaxial cable 21 carries the high power signal to the vertically polarized log periodic antenna 11. The antenna 11 radiates the RF signal at the helicopter 13 under test. Many times during a test the helicopter will have rotors turning at full speed. The pilots will function through different operations of the helicopter (while remaining on ground) and verify proper operation of the helicopter subsystems (communication equipment, radios, navigation equipment, etc.).

Figure 2:
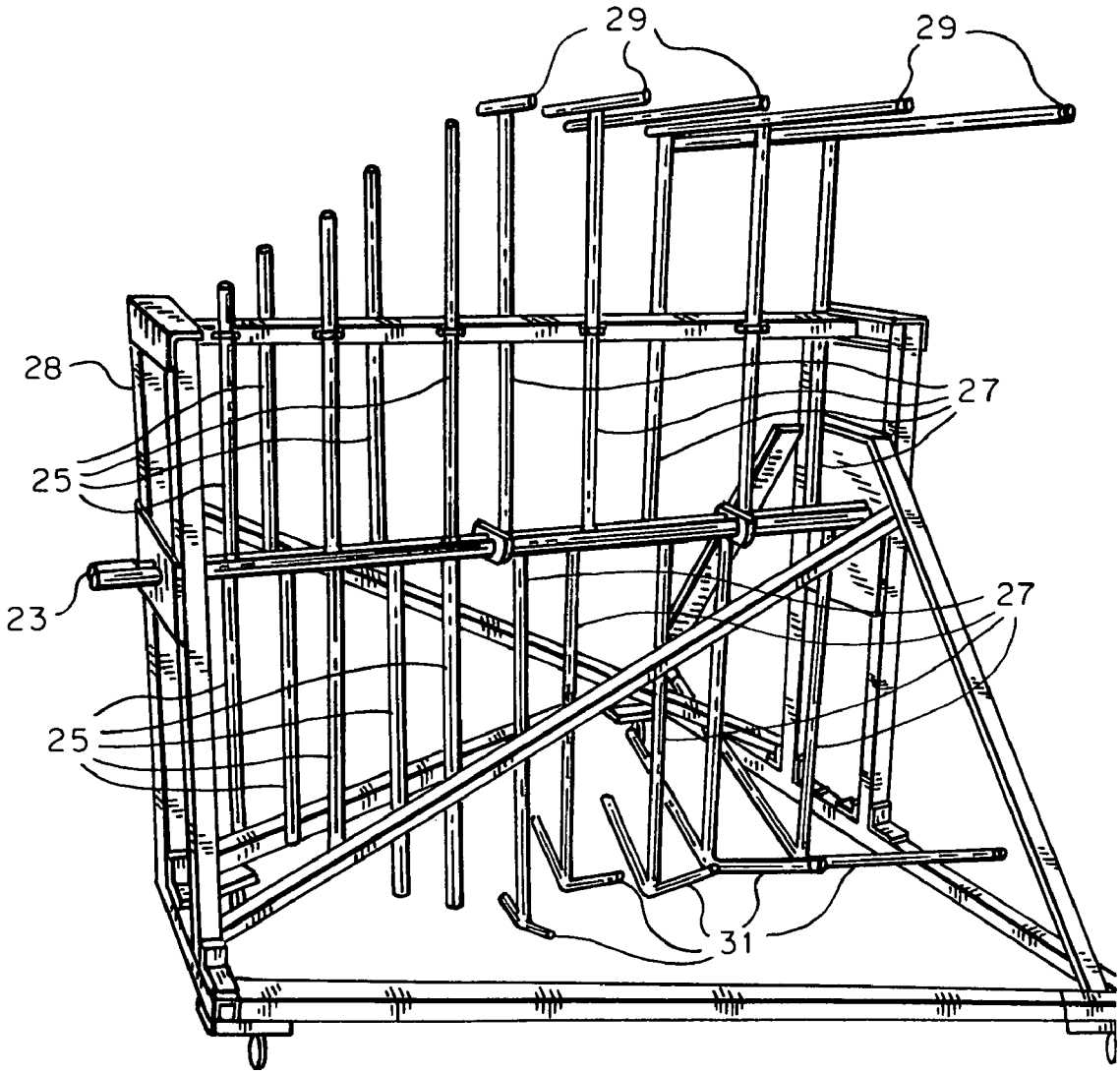
FIG. 2 shows a vertically polarized log periodic antenna in accordance with the invention.

FIG. 2 shows the vertically polarized log periodic antenna 11 in more detail. The antenna 11 includes antenna booms 23, normal length antenna radiating elements 25 connected to the booms 23, shortened length antenna radiating elements 27 connected to the booms 23, tuned upper horizontal antenna radiating elements 29 connected to the shortened length elements 27, and tuned lower bent horizontal antenna radiating elements 31 connected to the shortened length elements 27. The antenna is contained in a support structure 28.

In operation, the RF signal is fed from the rear of the antenna 11, through the booms 23, to the front of the antenna 11. The RF energy gets to the tuned upper horizontal antenna radiating elements 29 and the tuned lower bent horizontal antenna radiating elements 31 at the same time. It radiates from the resonating elements into free space and is directed at the helicopter 13 under test.

The normal length antenna radiating elements 25 are the normal length, as dictated in standard log periodic antenna design. These particular elements are short enough to fit vertically under a helicopter's main rotor (less than 6 feet tall).

The shortened length antenna radiating elements 27 (using standard log periodic antenna design) are too long to safely fit vertically under a helicopter's main rotor. Therefore, they have to be shortened to give an overall height of less than 6 feet. However, when the elements are shortened this way, the overall performance characteristics of the antenna are severely degraded. One cannot just make an antenna any size he wants to and expect any notable performance. In order to regain the desired performance, the tuned upper and lower horizontal elements 29 and 31 are added to the shortened elements to bring the elements back to their desired frequency resonance and thus ensure proper radiation from the antenna 11.

The tuned upper horizontal antenna radiating elements 29 are added (welded to maintain an electrical connection) to the shortened vertical elements 27 to regain the intended frequency resonance for each element. In basic terms, the extra horizontal length added allows extra room for the current on each element to flow, thus changing that particular element's resonance back to the original design. This works well, because the RF current closer to the tip of the element is much lower than the RF current flow near the boom. This phenomenon helps keep the integrity of the vertical polarization and shortens the element length at the same time.

The tuned lower horizontal antenna radiating elements 31 are added (welded to maintain an electrical connection) to the shortened vertical elements 27 to regain the intended frequency resonance for each element. However, since these lower elements are so close to the ground, RF coupling from the antenna to ground deteriorates the intended antenna performance. There is a capacitive coupling effect between the lower horizontal elements and the ground which changes the intended resonance of each particular shortened element. Therefore, each of the lower horizontal tuned elements is bent upwards (away from the ground), to reduce the capacitive coupling to ground. This returns each shortened element's resonance back to the desired resonance in the presence of the ground.

For a clearer understanding of the invention, a specific example of it is set forth below. The example is merely illustrative and is not to be understood as limiting the scope and underlying principles of this invention in any way.

EXAMPLE

Figure 3:
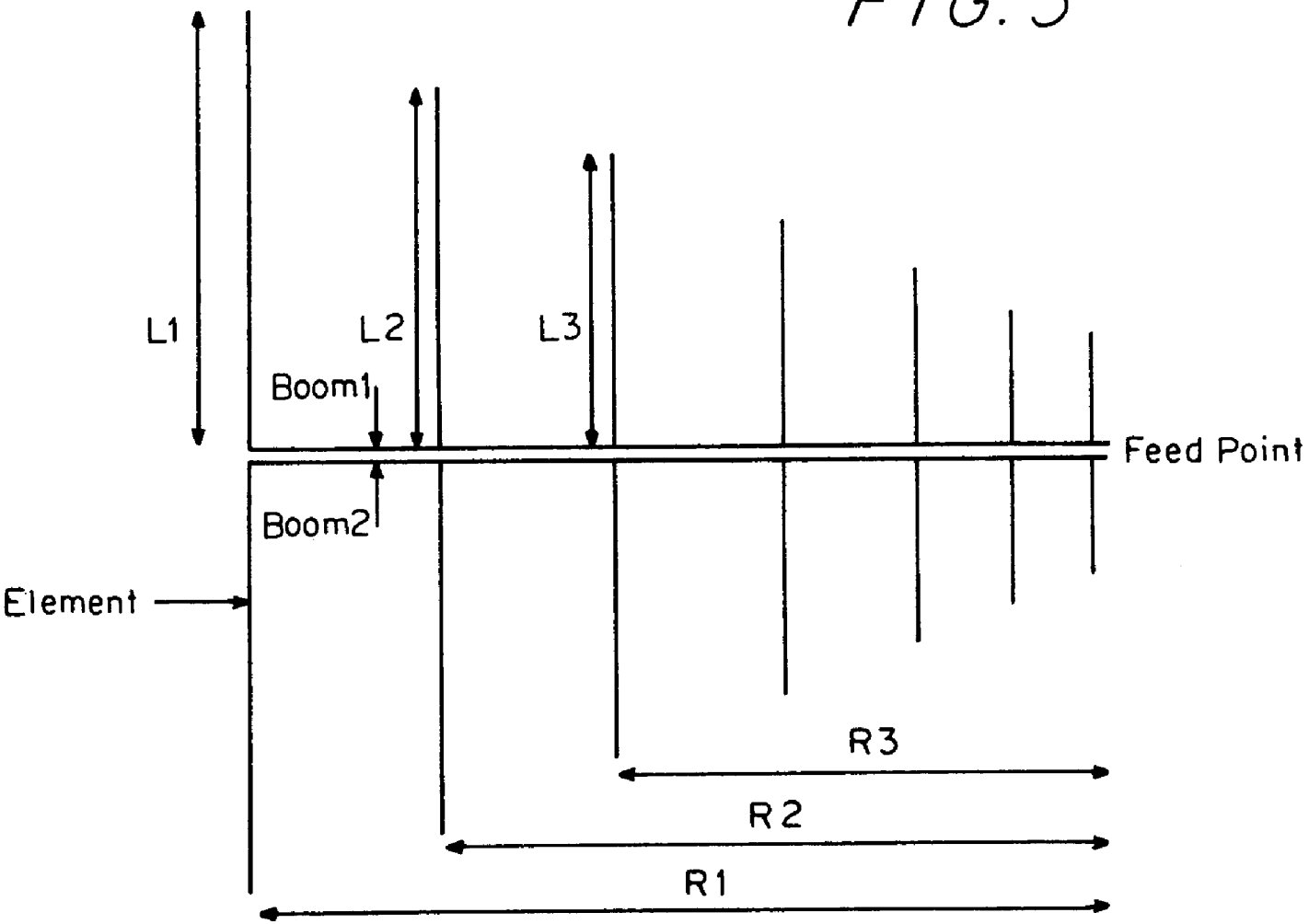
FIG. 3 is a diagram of log periodic antenna design characteristics.

A log periodic antenna (without any elements shortened) was designed using the values in Table 1 applied to the layout in FIG. 3.

TABLE 1

Values for the length (L) of each element and the distance (R) from each element to the feed point.

| Element | Length of Element (m) | R from Feed Point (m) |
|---|---|---|
| 1 | 1.4744 | 1.636 |
| 2 | 1.3099 | 1.401 |

TABLE 1-continued

Values for the length (L) of each element and the distance (R) from each element to the feed point.

| Element | Length of Element (m) | R from Feed Point (m) |
|---|---|---|
| 3 | 1.1634 | 1.192 |
| 4 | 1.0334 | 1.006 |
| 5 | 0.9174 | 0.84 |
| 6 | 0.8139 | 0.693 |
| 7 | 0.7224 | 0.562 |
| 8 | 0.6404 | 0.445 |
| 9 | 0.5679 | 0.341 |
| 10 | 0.5029 | 0.248 |
| 11 | 0.4454 | 0.166 |
| 12 | 0.3944 | 0.093 |

The antenna had a total of 12 elements and an overall length of 1.75 meters. There were two booms (to which the elements were mounted) with alternating elements as shown in FIG. 3. Each boom had an outer diameter of 1⅝ inches. The longest element was 1.4744 meters, which translated to an overall antenna height of slightly over 10 feet, considering the width of the boom and a couple inches of ground separation. This original design had an operation frequency from 50-160 MHz. In order to reduce the height to 6 feet, the first 5 longest elements were trimmed to 0.8938 meters (2.93 feet). This changed their resonant frequency to a higher frequency. To compensate for this, frequency tuned horizontal elements were added to the ends of the trimmed vertical elements. These horizontal elements created a capacitive effect that could be tuned to match the desired resonant frequency. The specific details can be found in Table 2.

TABLE 2

Values for the length (L) of each element and the distance (R) from each element to the feed point. The first 5 elements were shortened and a horizontal element was added to lower the resonant frequency to the desired level.

| Element | Length of Element (m) | R from Feed Point (m) | Extra Length Required (m) | Aluminum Tubing Diameter (inches) |
|---|---|---|---|---|
| 1 | 0.8938 | 1.636 | 1.50 | 1 |
| 2 | 0.8938 | 1.401 | 1.04 | 1 |
| 3 | 0.8938 | 1.192 | 0.80 | ⅝ |
| 4 | 0.8938 | 1.006 | 0.45 | ⅝ |
| 5 | 0.8938 | 0.84 | 0.19 | ⅝ |
| 6 | 0.8139 | 0.693 | | ⅝ |
| 7 | 0.7224 | 0.562 | | ⅝ |
| 8 | 0.6404 | 0.445 | | ⅝ |
| 9 | 0.5679 | 0.341 | | ⅝ |
| 10 | 0.5029 | 0.248 | | ⅝ |
| 11 | 0.4454 | 0.166 | | ⅝ |
| 12 | 0.3944 | 0.093 | | ⅝ |

The resulting overall height of the antenna with ground clearance was right at 6 feet. It was noted that when the antenna was placed within a couple inches of the ground, capacitive coupling occurred between the bottom horizontal elements and the ground. This coupling also changed resonant frequency and affected the voltage standing wave ratio (VSWR) at the desired frequencies of the shortened elements. To fix this, the lower horizontal elements were bent up from the center at 25 degrees to reduce the capacitive coupling to ground, and regain the required frequency characteristics. The new operational frequency range was then determined to be 40-165 MHz. Table 3 displays the electric field generated by the reduced height antenna for a given input power of 10 kW or less, depending on the output of the radio frequency (RF) amplifier.

TABLE 3

Electric Field levels obtained at 2 and 3 meters distance from the reduced height antenna. Vertical LP #1 Configuration #1

| | 2 Meters | | 3 meters | |
|---|---|---|---|---|
| Freq. (MHz) | Power (W) (forward/ref) | E-Field (V/m) | Power (W) (forward/ref) | E-Field (V/m) |
| 40 | 9411/655 | 284 | 9378/666 | 221 |
| *44 | 10k/190 | 382 | 10k/197 | 316 |
| 45 | 10k/545 | 381 | 10k/574 | 307 |
| 50 | 10k/36 | 482 | 10k/29 | 404 |
| *54 | 10k/703 | 423 | 10k/717 | 350 |
| 55 | 9k/1274 | 416 | 9k/1237 | 324 |
| *56 | 8k/1600 | 360 | 8k/1618 | 287 |
| 60 | 10k/1000 | 465 | 10k/1032 | 393 |
| *61 | 10k/648 | 447 | 10k/651 | 373 |
| *65 | 10k/988 | 462 | 10k/1000 | 386 |
| *67 | 10k/1252 | 416 | 10k/1255 | 332 |
| 70 | 10k/655 | 428 | 10k/673 | 350 |
| 75 | 9353/1354 | 446 | 9019/1259 | 355 |
| *76 | 10k/1300 | 456 | 10k/1373 | 366 |
| *80 | 10k/871 | 428 | 9569/772 | 336 |
| *85 | 10k/490 | 419 | 10k/545 | 328 |
| 90 | 10k/0 | 351 | 10k/0 | 254 |
| 95 | 10k/0 | 358 | 10k/0 | 232 |
| *97 | 9250/560 | 316 | 9670/205 | 210 |
| 100 | 9147/648 | 236 | 10k/0 | 341 |
| 105 | 10k/25 | 270 | 10k/0 | 263 |
| *110 | 9865/270 | 281 | 9600/510 | 209 |
| 115 | 10k/241 | 311 | 10k/223 | 211 |
| 120 | 10k/84 | 355 | 10k/95 | 254 |
| 125 | 8k/1695 | 305 | 9k/1925 | 229 |
| 130 | 9k/1442 | 273 | 8800/1885 | 228 |
| 135 | 9700/1614 | 414 | 10k/1545 | 314 |
| *140 | 10k/996 | 410 | 10k/787 | 329 |
| 145 | 9k/238 | 408 | 8500/230 | 305 |
| 150 | 8323/545 | 440 | 8272/622 | 335 |
| 155 | 9k/0 | 469 | 9000/0 | 363 |
| 160 | 10k/882 | 450 | 10k/900 | 358 |
| 165 | 6k/20.9 | 285 | 6k/2087 | 229 |
| 170 | 154⅝38 | 119 | 2k/1208 | 109 |

These levels can be compared to the Aviation Engineering Directorate specified test frequencies and required test levels (shown in Table 4) as stated in ADS-37A-PRF Table 1 Part A and MIL-STD-464A Table 1E.

TABLE 4

Specific Test Frequencies and Test Levels required for the reduced height antenna to meet.

| AED Specified Test Frequency (MHz) | ADS-37A-PRF Table 1 Part A Field Levels (V/m) | MIL-STD-464A Table 1E Field Levels (V/m) |
|---|---|---|
| 44 | 200 | 264 |
| 54 | 200 | 264 |
| 56 | 200 | 264 |
| 61 | 200 | 264 |
| 65 | 200 | 264 |
| 67 | 200 | 264 |
| 76 | 200 | 264 |
| 80 | 200 | 264 |

TABLE 4-continued

Specific Test Frequencies and Test Levels required for the reduced height antenna to meet.

| AED Specified Test Frequency (MHz) | ADS-37A-PRF Table 1 Part A Field Levels (V/m) | MIL-STD-464A Table 1E Field Levels (V/m) |
|---|---|---|
| 85 | 200 | 264 |
| 97 | 200 | 264 |
| 110 | 200 | 264 |
| 140 | 200 | 264 |

It can be seen that the reduced height antenna can meet the MIL-STD-464A Table 1E requirements (264V/m) at 2 meters and the ADS-37A-PRF Table 1 Part A requirements (200V/m) at 3 meters. This is a vast improvement over the previous antenna that could only generate the ADS-37A-PRF levels at 1 meter.

The dimension lengths for each of the elements are listed in Table 2. The first two elements (with horizontal pieces) were made with 1 inch diameter tubing, and the elements numbered 3 to 12 were fabricated using ⅝ inch diameter tubing. The boom was made with 1⅝ inch diameter tubing, with a center conductor of boom 1 being ⅝ inches in diameter.

All elements and both booms were made with aluminum tubing. The spacers for the antenna booms were made of Teflon (virgin grade PTFE). The support structure was made of Fiberglass, which design is not included here because its shape does not influence performance other than keeping the antenna 2 inches off the ground.

Figure 4:
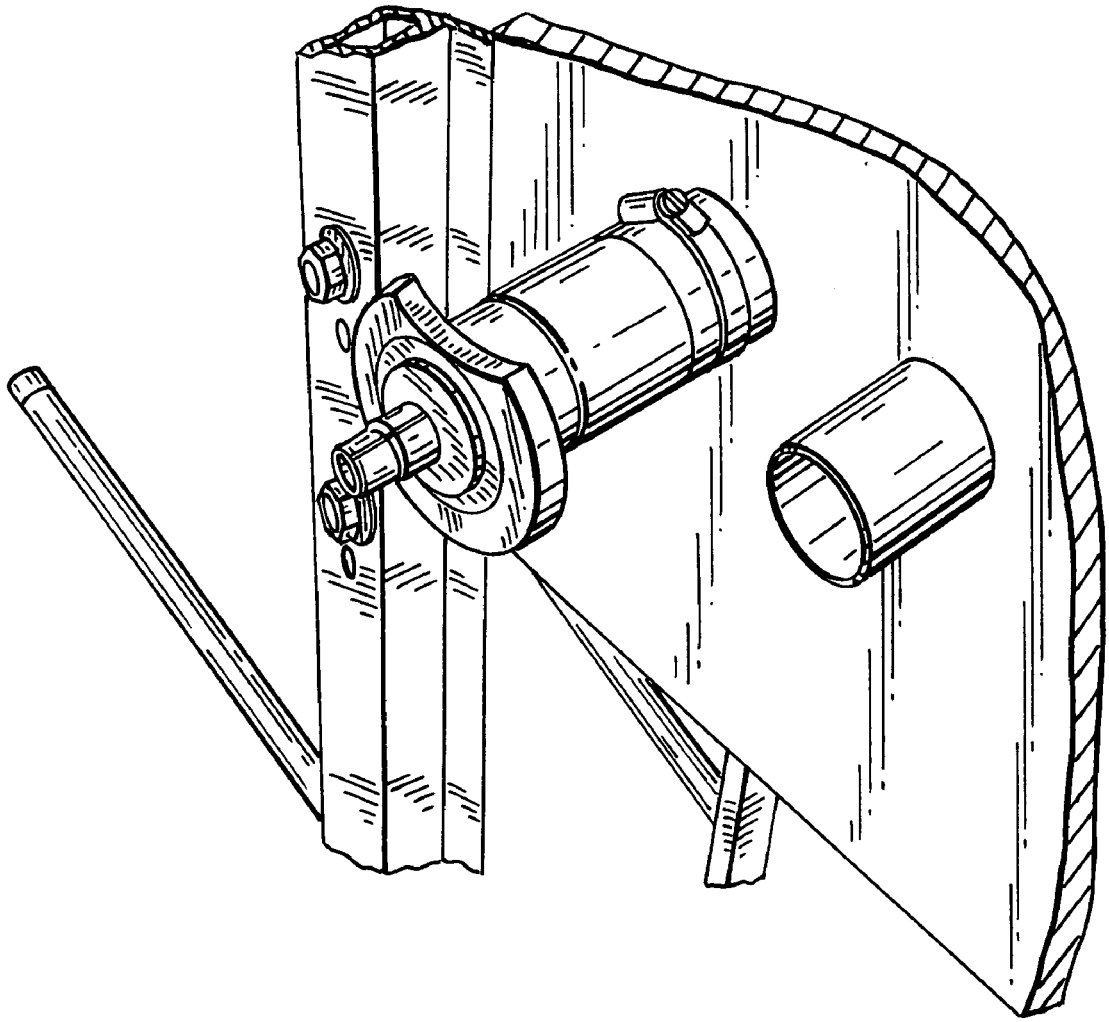
FIG. 4 shows a flange coaxial cable to antenna connector for the antenna (located at the rear).

Only one connector was needed to drive the reduced height antenna. This connector was located at the rear of the antenna as illustrated in FIG. 4. It was a standard 1⅝ EIA Flange connector that was mated directly to the 1⅝ inch boom and 0.5 inch center conductor.

Figure 5:
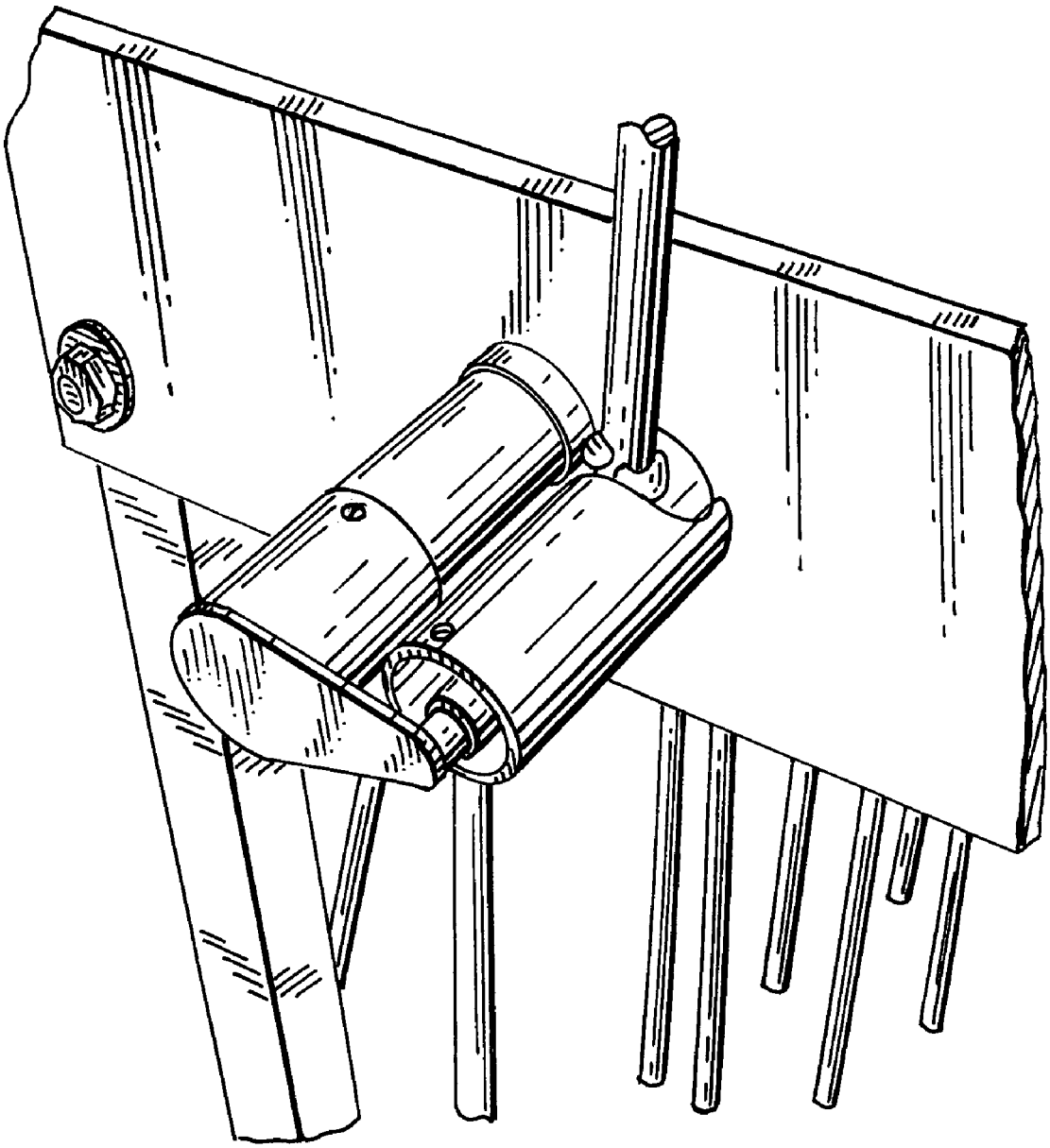
FIG. 5 shows the feed point of the antenna (located at the front).

The feed point was located in the very front of the antenna as shown in FIG. 5. The feed point was a direct connection between the center conductor of boom 1 and the outer tube of boom 2.

Teflon (virgin grade PTFE) dielectric separators were placed between the two booms at a separation of 1⅞ inches in the rear and ⅜ inches at the front. These separators were to keep the booms at a specific distance apart at all times. Additional Teflon "donut" spacers were placed inside boom 1 to keep the center conductor centered inside the boom.

It is obvious that many modifications and variations of the present invention are possible in light of the above teachings. It is therefore to be understood that within the scope of the appended claims, the invention may be practiced otherwise than as described.

The invention claimed is:

1. A reduced height vertically polarized log periodic antenna comprising:

a pair of antenna booms;

a first plurality of vertical antenna radiating elements connected to the booms;

a second plurality of vertical antenna radiating elements connected to the booms;

a plurality of tuned horizontal antenna radiating elements, each tuned horizontal radiating element connected to the top of one of the second plurality of vertical antenna radiating elements; and a plurality of tuned upwardly bent horizontal antenna radiating elements, each tuned upwardly bent horizontal antenna radiating element connected to the bottom of one of the second plurality of vertical antenna radiating elements, the second plurality of antenna radiating elements having been shortened from their original design length to fit vertically under the rotating blades of a helicopter, and the tuned horizontal radiating elements having been added to the shortened radiating elements to bring the shortened radiating elements back to their desired frequency response.

2. The antenna recited in claim 1 wherein the upwardly bent radiating elements are bent upwards at 25 degrees away from the ground to reduce the capacitive coupling to the ground.

3. The antenna recited in claim 1 wherein the booms are made with aluminum tubing.

4. The antenna recited in claim 1 wherein the radiating elements are made with aluminum tubing.

5. The antenna recited in claim 1 including a support structure for containing the antenna.

6. The antenna recited in claim 5 wherein the support structure is made of fiberglass.

7. A reduced height vertically polarized log periodic antenna comprising:

a pair of antenna booms made with aluminum tubing;

a first plurality of vertical antenna radiating elements connected to the booms;

a second plurality of vertical antenna radiating elements connected to the booms;

a plurality of tuned horizontal antenna radiating elements, each tuned horizontal radiating element connected to the top of one of the second plurality of vertical antenna radiating elements; and a plurality of tuned upwardly bent at 25 degrees away from the ground horizontal antenna radiating elements, each tuned upwardly bent horizontal antenna radiating element connected to the bottom of one of the second plurality of vertical antenna radiating elements; and a fiberglass support structure for containing the antenna, wherein the radiating elements are made with aluminum tubing, the second plurality of antenna radiating elements having been shortened from their original design length to fit vertically under the rotating blades of a helicopter, and the tuned horizontal radiating elements having been added to the shortened radiating elements to bring the shortened radiating elements back to their desired frequency response.

8. A method of reducing the height of a vertically polarized log periodic antenna so that the antenna may safely be positioned under the rotating blades of a helicopter sitting on the ground and still resonate in the frequency range at which the antenna was originally designed to resonate, comprising the steps of:

providing the vertically polarized log periodic antenna;

shortening any radiating elements of the antenna that are too long to fit vertically under the rotating main rotor of the helicopter;

adding tuned upper and lower horizontal radiating elements to the shortened radiating elements to bring the shortened radiating elements back to their desired frequency response; and bending the tuned lower horizontal radiating elements upwards away from the ground to reduce the capacitive coupling to the ground.

9. The method recited in claim 8 wherein the radiating elements are made with aluminum tubing, and the adding step is carried out by welding the tuned upper and lower horizontal radiating elements to the shortened radiating elements.

10. The method recited in claim 8 wherein the bending step is carried out by bending the tuned lower horizontal radiating elements upwards at 25 degrees away from the ground.

11. The method recited in claim 8 wherein the radiating elements are made with aluminum tubing, the adding step is carried out by welding the tuned upper and lower horizontal radiating elements to the shortened radiating elements, and wherein the bending step is carried out by bending the tuned lower horizontal radiating elements upwards at 25 degrees away from the ground.

12. A reduced height vertically polarized log periodic antenna produced by the method of claim 8.

13. A reduced height vertically polarized log periodic antenna produced by the method of claim 9.

14. A reduced height vertically polarized log periodic antenna produced by the method of claim 10.

15. A reduced height vertically polarized log periodic antenna produced by the method of claim 11.

* * * * *